US008183914B2

(12) United States Patent
Tsai et al.

(10) Patent No.: US 8,183,914 B2
(45) Date of Patent: May 22, 2012

(54) CONSTANT GM CIRCUIT AND METHODS

(75) Inventors: Tsung-Hsien Tsai, Hsin-Chu (TW); Chien-Hung Chen, Taipei (TW); Min-Shueh Yuan, Taipei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 265 days.

(21) Appl. No.: 12/617,583

(22) Filed: Nov. 12, 2009

(65) Prior Publication Data

US 2010/0176777 A1 Jul. 15, 2010

Related U.S. Application Data

(60) Provisional application No. 61/144,011, filed on Jan. 12, 2009.

(51) Int. Cl.
*G05F 1/575* (2006.01)
*G05F 1/567* (2006.01)

(52) U.S. Cl. ..... 327/543; 327/541; 327/513; 323/316

(58) Field of Classification Search ..... None
See application file for complete search history.

(56) References Cited

U.S. PATENT DOCUMENTS 7,372,316 B2 * 5/2008 Chatterjee et al. ..... 327/513
7,786,771 B2 * 8/2010 Tsai et al. ..... 327/156

* cited by examiner

*Primary Examiner* — Lincoln Donovan
*Assistant Examiner* — Terry L Englund
(74) *Attorney, Agent, or Firm* — Slater & Matsil, L.L.P.

(57) ABSTRACT

Structures and methods for providing a temperature independent constant current reference are provided. A constant Gm circuit is disclosed with embodiments including a voltage controlled resistor providing a current into a current mirror, the current mirror sinking a reference current at its output. By providing a feedback loop that controls the voltage controlled resistor, a temperature compensated circuit may be obtained. The temperature dependence of the voltage controlled resistor is positive and the feedback circuitry maintains this resistor at a value that compensates for the negative temperature dependence of the current mirror circuit. The reference current is thus obtained at a predetermined level independent of temperature. A method for providing a reference current is disclosed wherein a voltage dependent resistor is provided supply current to a current mirror, the voltage dependent resistor receiving a feedback voltage from the current mirror and the feedback controlling the resistor so that a temperature independent reference current is obtained.

20 Claims, 10 Drawing Sheets

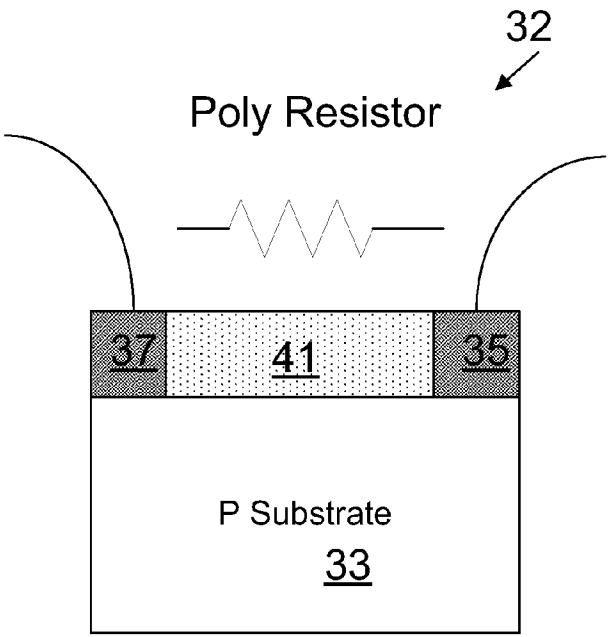
FIG. 3b
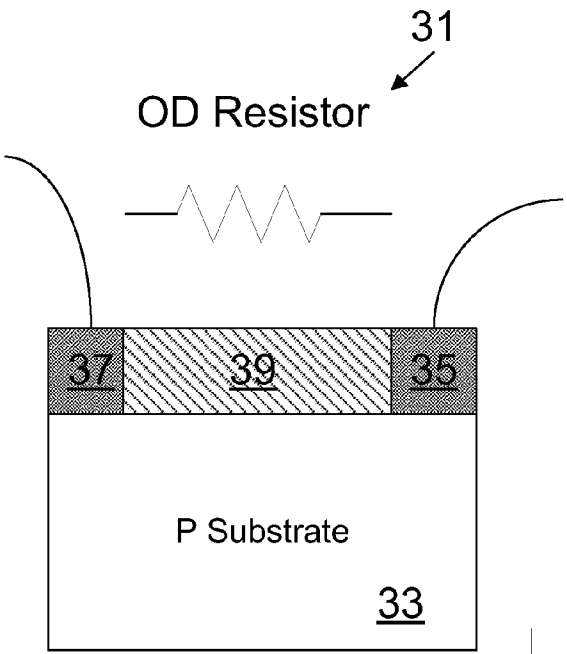
FIG. 3a
FIGURE 3
(PRIOR ART)

CONSTANT GM CIRCUIT AND METHODS

This application claims the benefit of U.S. Provisional Application No. 61/144,011, entitled "Constant Gm Circuit and Methods," filed on Jan. 12, 2009, which is incorporated herein by reference.

TECHNICAL FIELD

The present invention relates to a circuit and methods for providing an improved constant transconductance (Gm) circuit and methods for providing a constant reference current, which are needed for advanced integrated circuits and are particularly useful for analog circuitry. The invention provides advantages in a circuit that provides a temperature independent constant current source especially when fabricated in advanced semiconductor process technology nodes.

BACKGROUND

A common requirement for an electronic circuit and particularly for electronic circuits including analog circuits that are manufactured as integrated circuits in semiconductor processes is a constant reference current. FIG. 1 depicts a constant Gm circuit of the prior art for providing a constant current Iref. A constant Gm circuit has a constant transconductance so the output current is ideally maintained at a predetermined current. If the circuit operated as an ideal circuit, current Iref would remain constant across variations in voltage supply Vdd variations and also be independent of process and temperature variations.

In FIG. 1, resistor R is implemented in the semiconductor process as an OD resistor and sometimes, a polysilicon resistor or combinations of these resistors. Transistors MP1, MN1, MN2, and MP2 provide a current mirror circuit wherein the current flowing through resistor R is also the reference current Iref at the circuit output. By selecting values for R and the sizes of transistors MP1, MN1, and matching the transistors MP2 and MN2 to MP1 and MN1 (note that as a known alternative, transistor size scaling can be used to vary Iref without changing the value of R), a predetermined reference current can be created at the output.

The current Iref is described by the expression:

$$Iref = \frac{2}{\mu_P C_{OX}\left(\frac{W}{L}\right) * R^2}\left(1 - \frac{1}{\sqrt{2}}\right)^2$$

Ideally, the reference current Iref would be independent of the temperature of the integrated circuit. In actuality, however, the terms R and the mobility term μPCox (W/L) in the denominator have temperature dependencies. Because the temperature dependence of the physical resistor R is not balanced with the temperature dependence of the mobility term, the current Iref that is observed in an actual circuit also has a temperature dependency. This is undesirable.

FIG. 2 depicts in FIGS. 2*a*, 2*b* and 2*c* the temperature dependency for an ideal and an actual mobility term, an ideal resistor and an actual resistor, and the resulting Iref current plotted over the usual temperature range for integrated circuits, −40 degrees C. to 125 degrees C., for the two cases. Because the mobility term (even in the ideal case) has negative temperature dependence, Iref also tends to have a temperature dependence that is significant, as the positive temperature dependence of the resistor R is not sufficient to compensate for it. Note the temperature dependence of Iref is positive (increases with increasing temperature), as it is proportional to the inverted mobility and resistor values.

As semiconductor processes advance, device sizes continue to decrease. Present semiconductor production includes 45 nanometer and soon 32 nanometer minimum feature sizes; these process milestones are usually referred to as "technology nodes". Advances towards 28 nanometer node mass production are underway and expected shortly. The trend to smaller devices and more advanced nodes will continue.

As the device sizes shrink commensurate with the advances in the semiconductor technology nodes, the device characteristics and performance become dominated by physical layout effects. The devices also exhibit wider performance differences due to semiconductor process variations and temperature. For advanced semiconductor processes and future semiconductor processes, the temperature dependence shown in FIG. 2 may become even more pronounced.

Note in FIG. 2*a* that the ideal case, with the resistor a horizontal line indicating no temperature dependence, is not the optimum solution for a temperature independent Iref. This can be seen clearly by noting that in FIG. 2*c*, the lower curve in Iref at −40 degrees is the ideal case, and it ends up higher at 125 degrees C., because the mobility term $\mu_p C_{ox}(W/L)_P$ in FIG. 2*a* has a temperature dependence, whether ideal or in an actual implementation. What is needed is a method to compensate the temperature dependence of the mobility term so that the Iref current is temperature independent.

FIG. 3 depicts in cross section two prior methods for forming the resistor R in a typical semiconductor process. FIG. 3*a* depicts an oxide diffusion resistor (OD resistor) 31 formed over the active area of the device between two conductors or metal lines 37, 39 that form the resistor terminals on a substrate 33. FIG. 3*b* depicts a polysilicon resistor 32 formed over the active area of a semiconductor substrate 33 between two conductors or metal lines 35, 37 that form the terminals of the resistor 41. These two approaches are sometimes used in combination to increase the resistance R. Nonetheless, additional improvements are still needed.

Thus, there is a continuing need for a constant Gm circuit that provides a temperature independent constant current source, while remaining compatible with existing and future semiconductor processes for integrated circuits.

SUMMARY OF THE INVENTION

These and other problems are generally solved or circumvented, and technical advantages are generally achieved, by embodiments of the present invention, which provides a voltage dependent adjustable resistor element for a constant Gm circuit that is used to provide temperature dependent compensation to balance the temperature dependent mobility term and thus provide a temperature independent reference current.

In a first exemplary embodiment of the invention, a voltage controlled resistor is provided in parallel to the resistor in a constant Gm circuit, and feedback is used to control the value of the voltage controlled resistor. In this manner, increased positive temperature dependence in the combined resistor may be developed. The resistor value may be selected to provide a balanced temperature dependency to compensate for the negative temperature dependence of the mobility term in the output reference current characteristic. The output current may then be maintained at a design level more or less independently of the substrate temperature.

In yet another embodiment, a feedback loop is provided in a constant Gm circuit. In the feedback loop, a voltage controlling the pull down transistors at the gates of the constant Gm circuit is monitored. As this voltage increases, an inverting amplifier with a gain outputs a decreasing voltage to a voltage controlled resistor. As the voltage decreases to this resistor, a voltage controlled current path increases current flowing through it, which decreases the resistance. In this manner, the feedback circuit compensates the current flowing in the constant Gm circuit to maintain the output reference current at a predetermined level. As temperature increases, the output reference current remains at the predetermined level independent of the operating temperature of the integrated circuit.

In yet another embodiment, a voltage controlled resistor is provided in a constant Gm circuit having positive temperature dependence. The negative temperature dependence of the constant Gm circuit due to the mobility term is determined. The voltage controlled resistor is provided with a positive temperature dependence designed to compensate for the negative temperature dependence over a range of operating temperatures. A feedback voltage is provided to the voltage controlled resistor to adjust the impedance and provide the positive temperature coefficient as the operating temperature increases, or decreases. A constant output reference current is obtained over temperature.

In yet another exemplary embodiment, a feedback loop is provided to adjust the resistor of a constant Gm circuit. The feedback loop may comprise an operational amplifier with a negative gain. The input to the amplifier may be an internal voltage that tends to increase with increasing temperature. The feedback loop provides a feedback voltage that decreases with increasing temperature. The feedback voltage may be coupled to a voltage controlled resistor to provide a compensation scheme for the constant Gm circuit.

In a method embodiment, a current is provided to a constant Gm circuit that is mirrored to provide a constant output current. An internal node voltage in the Gm circuit is observed which tends to increase with temperature. A feedback voltage is developed that corresponds to the internal node voltage but decreases with temperature. The current provided to the constant Gm circuit is varied responsive to the feedback voltage. In this manner, an output current is maintained at a predetermined design level over temperature variations.

The foregoing has outlined rather broadly the features and technical advantages of the present invention so that the detailed description of the invention that follows may be better understood. This summary section briefly describes certain exemplary embodiments of the invention, but the invention is not limited only to these exemplary embodiments.

Additional features and advantages of the invention will be described hereinafter, which form the subject of the claims of the invention. It should be appreciated by those skilled in the art that the conception and specific embodiment disclosed might be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE FIGURES

For a more complete understanding of the present invention, and the advantages thereof, reference is now made to the following descriptions taken in conjunction with the accompanying drawing, in which:

FIG. 3 illustrates two prior art semiconductor resistor elements in cross section; FIG. 3*a* illustrates an oxide diffusion resistor; FIG. 3*b* depicts a polysilicon resistor;

The drawings, schematics and diagrams are illustrative, not intended to be limiting but are examples of embodiments of the invention, are simplified for explanatory purposes, and are not drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
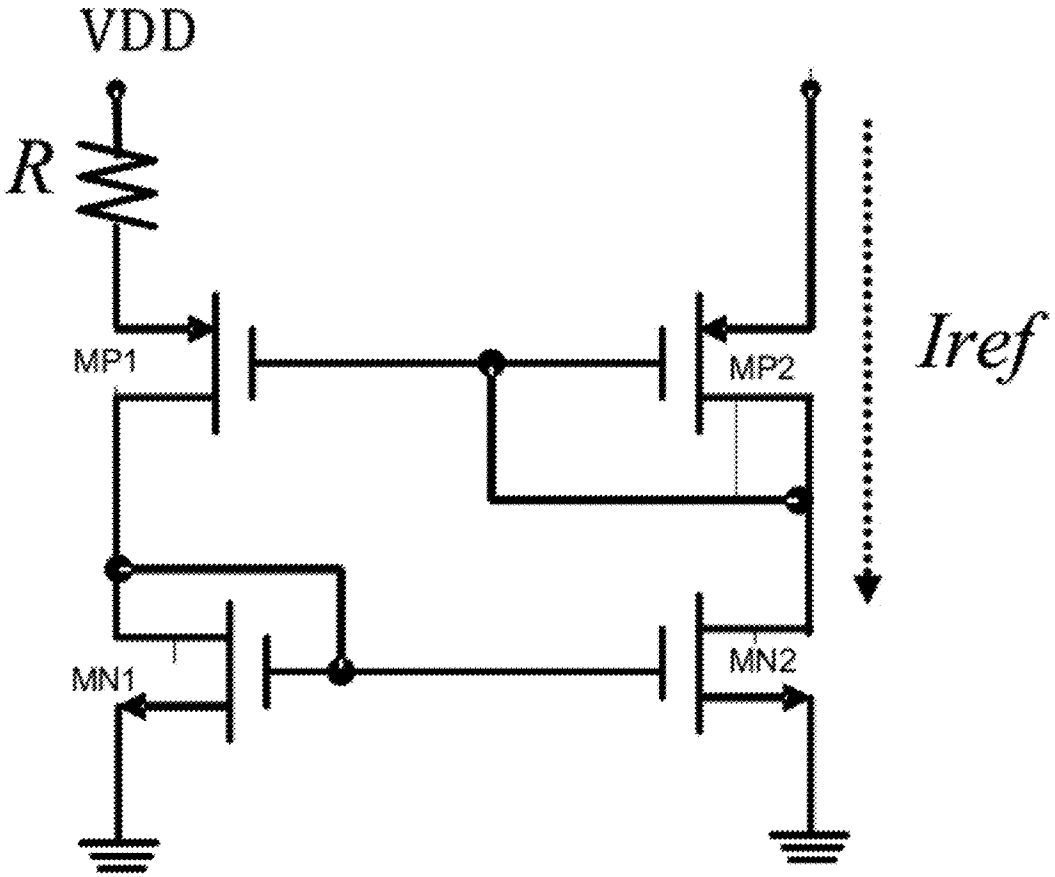
FIGURE 1 PRIOR ART
FIG. 1 illustrates a prior art constant Gm circuit.
Figures 2, 2A, 2B, 2C:
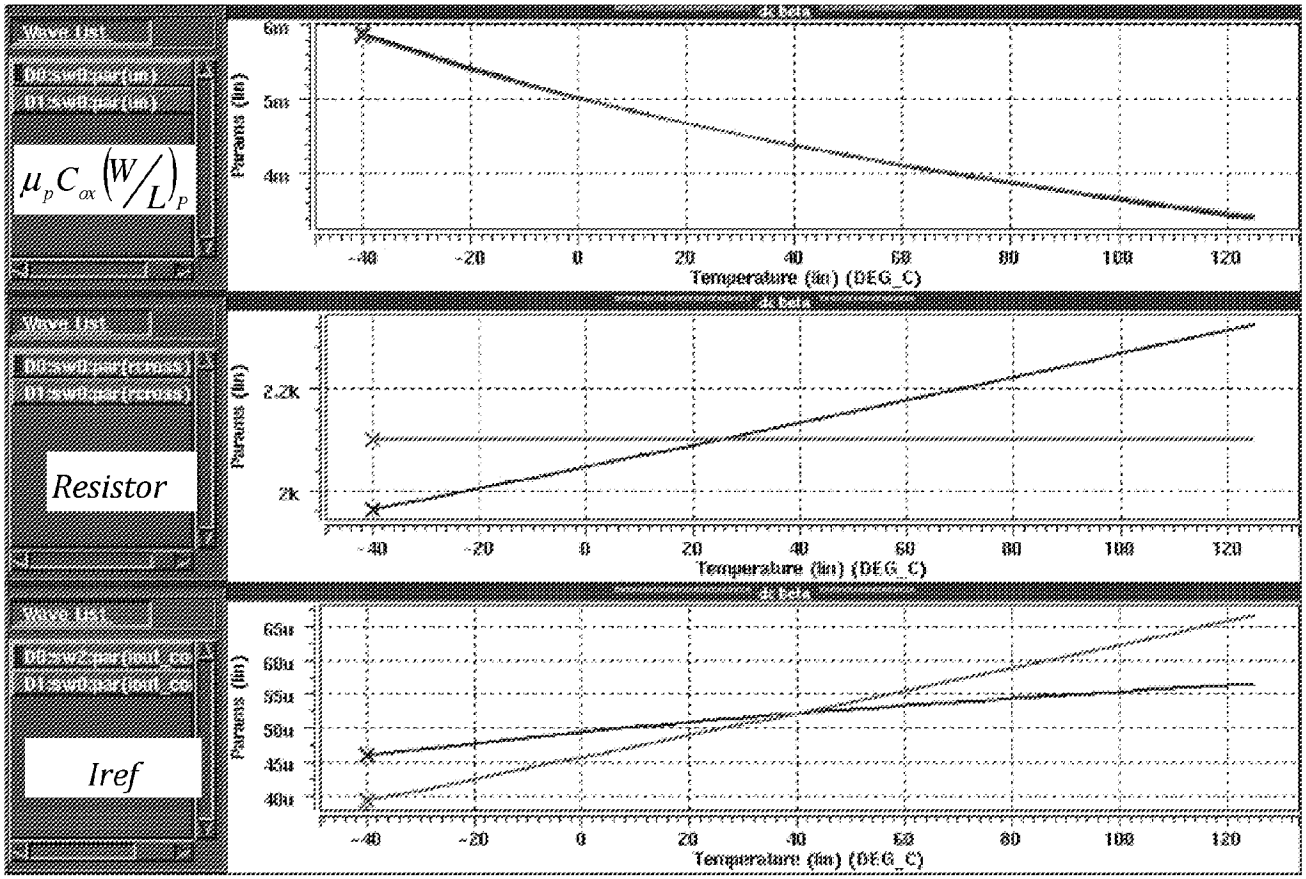
FIGURE 2 (PRIOR ART)
FIG. 2 depicts the temperature dependence of circuit elements of the circuit of FIG. 1.
FIG. 2*a* depicts the temperature dependence of the mobility term.
FIG. 2*b* depicts the temperature dependence of the resistor.
FIG. 2*c* depicts the temperature dependence of Iref.
Figure 4:
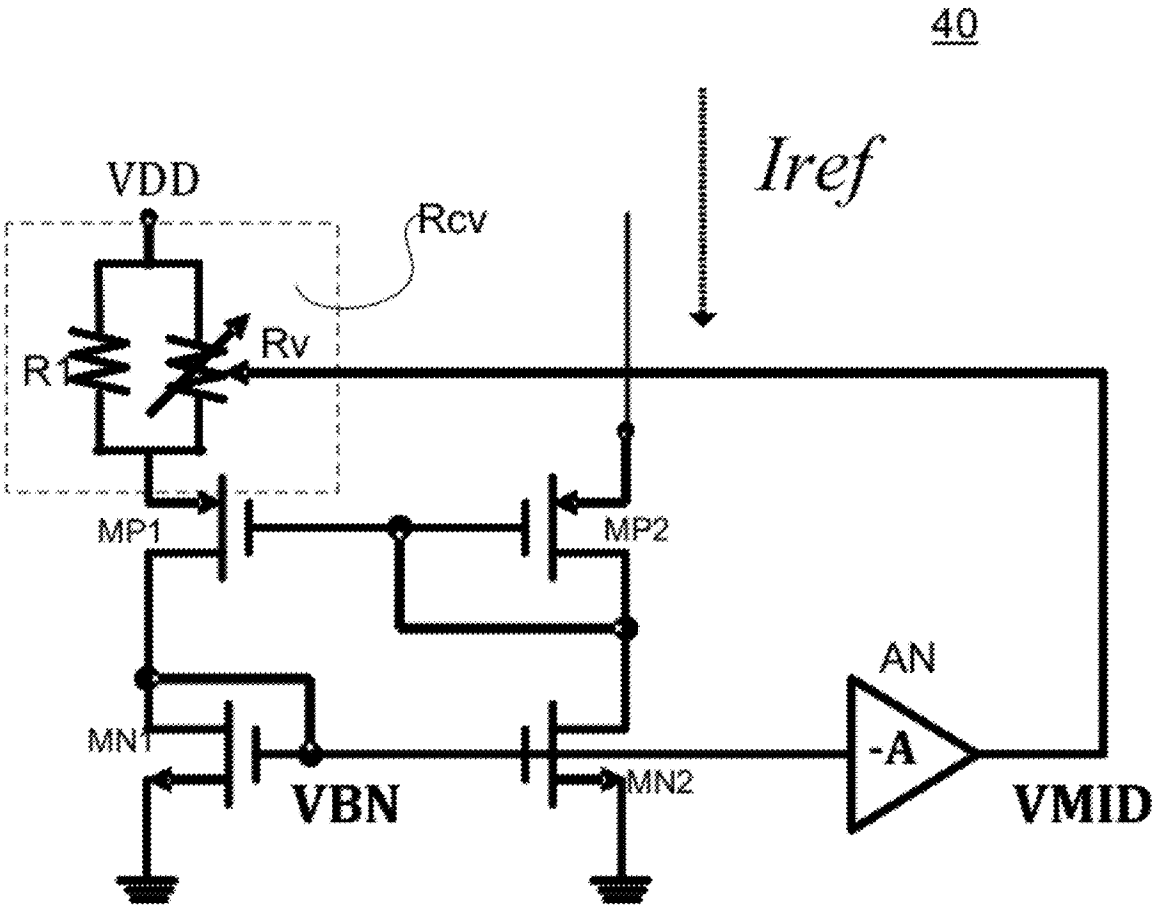
FIG. 4 illustrates in a schematic view a first embodiment of a constant Gm circuit of the present invention.

FIG. 4 depicts in one exemplary embodiment a constant Gm circuit of the present invention. In FIG. 4, a voltage controlled resistor Rcv is provided. In one embodiment the variable resistor Rv is provided in parallel with a known resistor R1, such as an OD or poly resistor, or alternatively, a combination of these. If the variable voltage dependent resistor is sufficiently large, the fixed resistor R1 may be omitted. Alternative voltage controlled resistors, including large transistors for example, may be used for Rcv and these arrangements form alternative embodiments that are further contemplated as part of the invention and which fall within the scope of the appended claims.

Transistors MP1, MN1, MN2 and MP2 provide the constant Gm circuit as before, with output current Iref.

A feedback amplifier AN with gain −A is coupled to receive the voltage VBN and output a voltage VMID that is inversely proportional, that is, because the gain is negative, the voltage VMID will decrease as voltage VBN increases, and vice versa.

As the internal voltage at node VBN increases, the voltage VMID decreases, which increases the resistor Rv. As voltage VBN decreases, the voltage VMID increases, which decreases the value of resistor Rv. In this manner, the feedback loop amplifier AN may compensate the circuit to maintain Iref at a predetermined, ideally constant level.

In operation, the constant Gm circuit 40 in FIG. 4 provides a current Iref generated at the output that is constant irrespective of the voltage VDD. This is so because transistor MN1 is diode connected and provides a gate voltage VBN that is a transistor threshold (typically, 0.5-0.8 Volts) above ground. Transistor MN2 thus receives this gate voltage and turns on to the same extent that transistor MN1 is on. Transistor MP2 is also diode connected and thus provides a voltage that is a transistor voltage threshold above ground. The gate voltage is likewise tied to transistor MP1 which supplies current to transistor MN1. Since the gate voltages are independent of VDD, the circuit should provide a constant current Iref even when VDD falls or increases slightly.

The current into the drain of MP1 is determined by the Ohms law ratio of I=V/R. Here, R is Rv, and may vary.

As the temperature rises, voltage VBN tends to fall. Feedback amplifier AN then outputs an increasing voltage VMID. This increasing voltage increases the resistor Rcv value.

Figure 5:
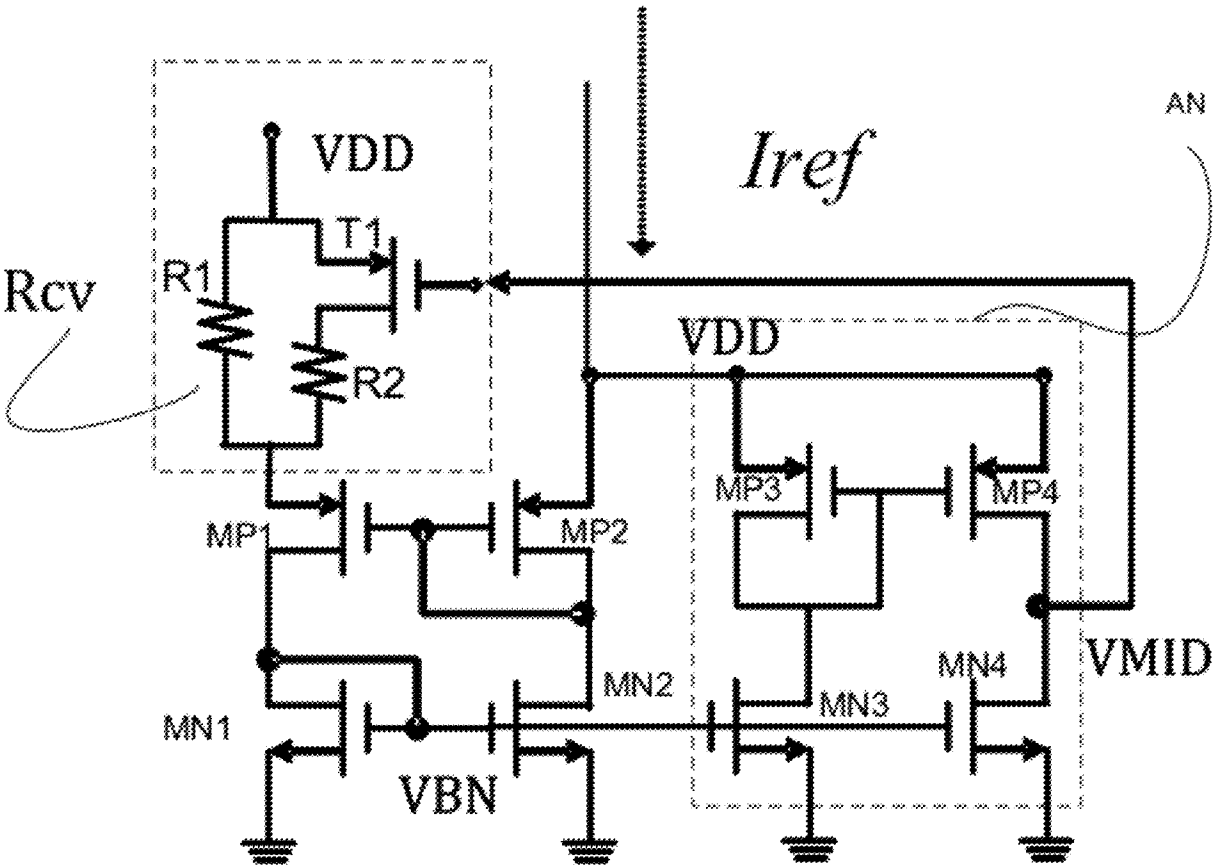
FIG. 5 illustrates in a schematic view a detailed implementation embodiment of a constant Gm circuit of the present invention.

FIG. 5 depicts, in one exemplary embodiment, a circuit implementation for the circuit in FIG. 4. In FIG. 5, resistor Rcv is implemented as resistor R1 in parallel with a resistor which comprises a fixed resistor R2 adapted to a voltage controlled current supply. In this example, a P type MOS transistor T1 is used. Alternatively, arrangements for providing current in response to the feedback voltage could be used in place of the transistor T1. Resistor R2 is series coupled to transistor T1 which receives VMID at its gate. Transistors MP1, MP2, MN1, and MN2 are all coupled to form a constant transconductance amplifier, as before. Voltage at node VBN, the gate voltage at the diode coupled transistor MN1, is coupled to feedback amplifier AN which comprises transistors MP3, MP4 and MN3, MN4. Amplifier AN provides a negative gain amplifier with VBN as an input. In operation, as the voltage at node VBN increases, VMID falls, as VBN decreases, VMID increases.

As the voltage VMID decreases, transistor T1 is turned on harder, which sends current through the resistor R2. This corresponds to a decrease is the value Rcv. In contrast, as the voltage VMID increases, the p type transistor T1 conducts less current, and current to R2 is reduced, which corresponds to an increase in the value of resistor Rcv.

Figures 6, 6A, 6B, 6C:
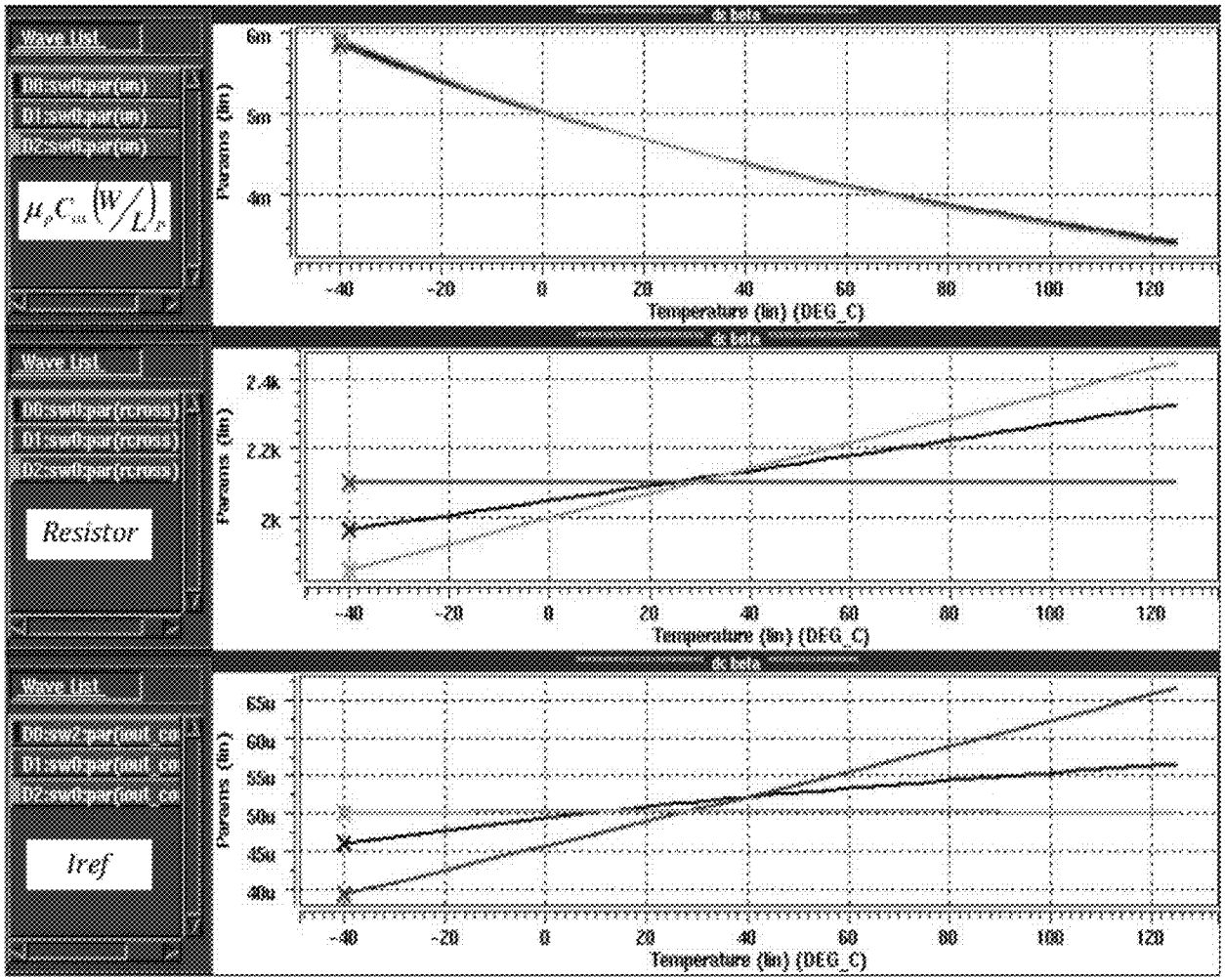
FIG. 6 illustrates in three graphical views, FIG. 6*a*, FIG. 6*b* and FIG. 6*c*, the temperature dependence of circuit elements of constant Gm circuits including the embodiment of FIG. 5.

FIG. 6 depicts three graphs, FIG. 6*a*, FIG. 6*b* and FIG. 6*c*, of the mobility term, the resistor, and the resulting current Iref over temperature for three cases. One case depicts the temperature dependence for the ideal circuit, one case for the prior art, and the third case is for the embodiments of the invention. The temperature dependence for the mobility term $\mu_p C_{ox}(W/L)_P$ is similar in all three cases. FIG. 6*a* shows negative temperature dependence; as the temperature increases the mobility term falls. In FIG. 6*b*, the resistor R is shown as an ideal case (middle line which remains horizontal), a prior art case, the darkest line with a mild positive temperature coefficient, and an embodiment of the invention where the voltage controlled resistor is adjusted with temperature to increase with temperature more sharply. The bottom graph, FIG. 6*c*, shows the resulting Iref in each case. The darkest line in FIG. 6*c* is for the prior art resistor case and shows a positive temperature coefficient. Iref begins at temperature −40 degrees C. at the left side of the graph at about 47 microamps, and as temperature increases to 125 degrees C., moves up to about 57 microamps. The worst line for Iref in FIG. 6*c* is actually the graph for a circuit with an ideal resistor, because the mobility term remains temperature dependent while the resistor R in the ideal case does not change over temperature. The resulting current Iref begins at a temperature of −40 degrees C. at around 40 microamps but transitions positively with increasing temperature to a value of about 65 microamps. The middle line, FIG. 6*c*, shows an Iref current with the temperature compensation using the voltage controlled resistor of the invention, for example, the embodiment of FIGS. 4 and 5. Iref begins at −40 degrees C. at around 50 microamps, and remains almost constant at that same level as temperature increases to 125 degrees C. This comparison graph therefore illustrates some of the advantages that may be accrued by use of embodiments of the invention.

Figures 7, 7A, 7B, 7C:
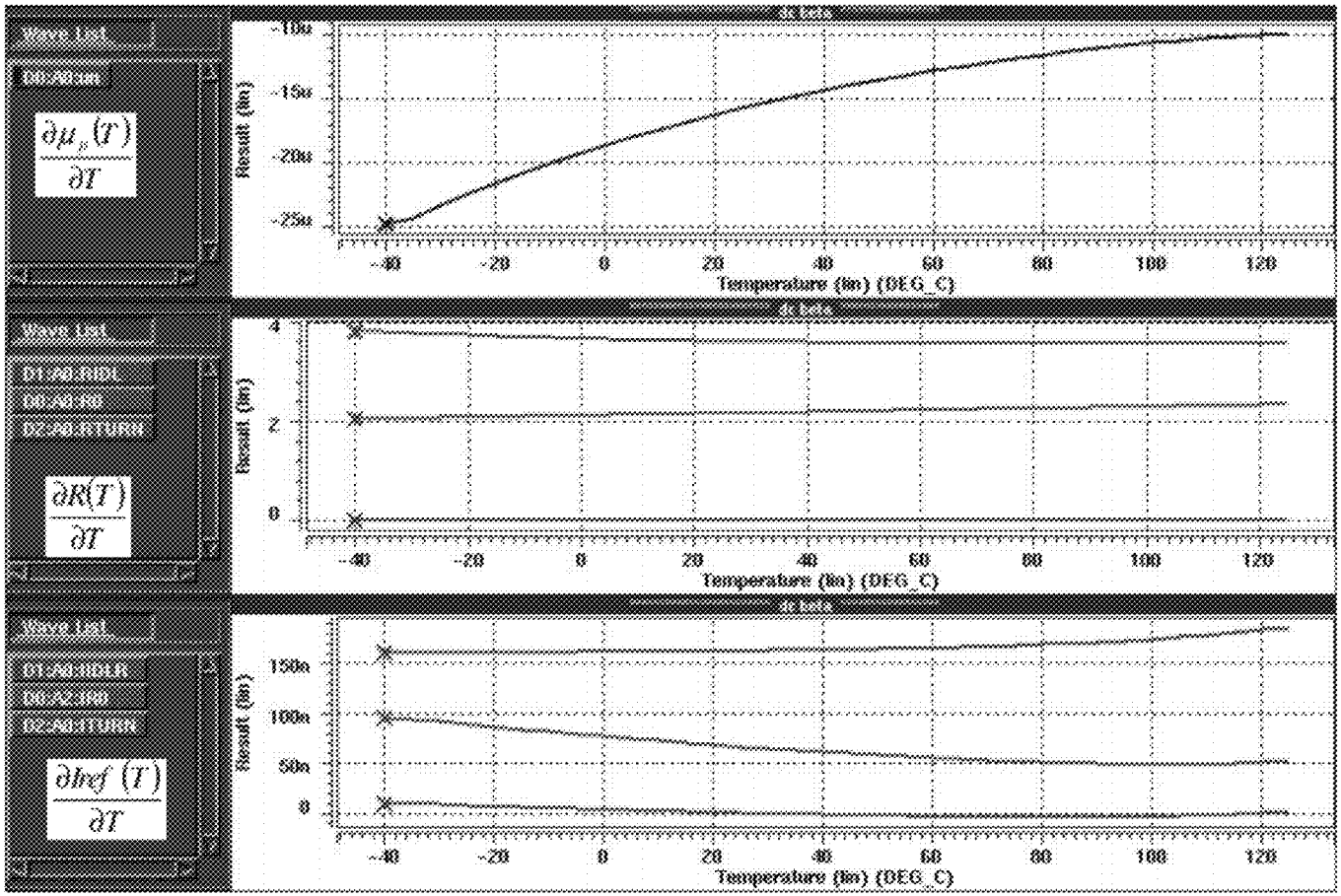
FIG. 7 illustrates in three graphical views, FIG. 7*a*, FIG. 7*b* and FIG. 7*c*, over temperature the differentials, with respect to temperature, of the graphical view illustrated in FIG. 6.

FIG. 7 further illustrates in three graphs, FIG. 7*a*, FIG. 7*b* and FIG. 7*c*, the temperature dependence of the three cases by using the derivative of each of the mobility term, the resistor, and the output current. The derivative of the output current may be expressed as:

$$\frac{\partial Iref(T)}{\partial T} = -\left(A'\frac{\partial \mu_p(T)}{\partial T} + B'\frac{\partial R(T)}{\partial T}\right) \approx 0$$

That is, for the correct operation of the circuit with a constant Iref output over temperature, the change of Iref with respect to temperature (the derivative) should be approximately zero.

Since the mobility term has a positive derivative in the above equation, the optimum design criterion for the voltage controlled resistance Rcv is one selected so that the slope of the resistor derivative (the resistor change with respect to temperature) is opposite of the mobility term derivative $$\frac{\partial \mu_p(T)}{\partial T}.$$

By arranging the feedback amplifier AN and the voltage controlled resistor Rcv of the embodiments of the invention so as to achieve this, a constant current reference Iref that is temperature independent is achieved.

In FIG. 7, the derivatives of the terms graphically shown in FIG. 6 are plotted over temperature. FIG. 7*a* depicts the $$\frac{\partial \mu_p(T)}{\partial T}$$

term in the to curve, noted for the ideal, the prior art, and the exemplary embodiment cases, these curves all overlap and have the same slope. The resistor temperature dependence $$\frac{\partial R(T)}{\partial T}$$

is shown in the middle graph, FIG. 7*b*. For the ideal case, the resistor is temperature independent and so the change over temperature is 0, as shown in the bottom trace. For the prior art approach, there is a slight positive slope and it is fairly linear. The derivative for the voltage dependent resistor of the embodiments is shown at the top of the graph. It has the largest magnitude, about twice the prior art, and a slight negative slope from −40 to 125 degrees, that is, the change with respect to temperature is higher for the colder temperatures and then falls slightly as temperature increases.

The rate of change in Iref, $$\frac{\partial Iref(T)}{\partial T}$$

over temperature, is depicted in FIG. 7*c*, the bottom graph, for the three cases. For the ideal resistor, the mobility term dominates, and therefore, the highest magnitude for the rate of change is shown for that case, shown in the top trace in FIG. 7*c*. The middle trace shows the derivative for the prior art circuit with a fixed, but temperature dependent, resistor R. The bottom trace shows that the rate of change for Iref in a circuit embodiment of the invention with respect to temperature is almost zero; this is the desired outcome. Again, by selecting the voltage dependent variable resistor and the feedback amplifier of the exemplary embodiments correctly, a constant current Iref that is temperature independent may be achieved in a constant Gm circuit.

Figures 8, 8A, 8B, 8C:
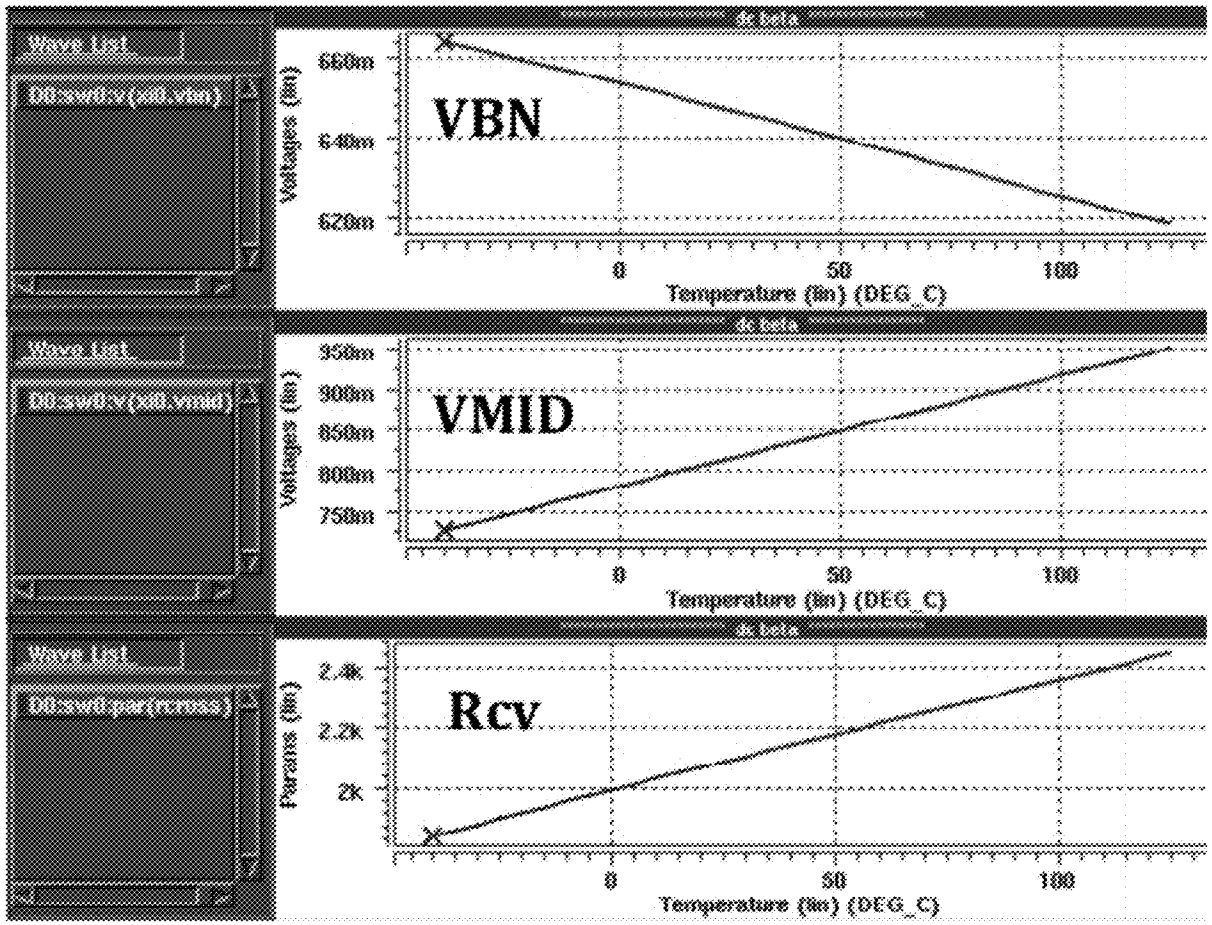
FIG. 8 depicts, in three graphical views, FIG. 8*a*, FIG. 8*b* and FIG. 8*c*, the value vs. temperature operation of the voltage VBN, the feedback voltage VMID, and the resistor Rcv, for the constant Gm circuit embodiment of FIG. 5.

FIG. 8 depicts in three graphical views, FIG. 8*a*, FIG. 8*b* and FIG. 8*c*, the relationship of three elements of the circuit embodiments of FIG. 5, plotted over temperature. In FIG. 8*a*, the trace shows that the voltage at node VBN falls over temperature. The voltage VBN therefore provides a direct correspondence to the mobility term over temperature. This correspondence is utilized advantageously in embodiments of the present invention to compensate the circuit. The output of the feedback amplifier, voltage VMID, is depicted in FIG. 8*b* over temperature and is shown in an inverse voltage having the same slope as the VBN voltage with respect to temperature. Again, this trace corresponds to the mobility term plotted over temperature, albeit inverted. FIG. 8*c* depicts the resistor value of the voltage controlled resistor Rcv. As the voltage VMID rises, the resistor value rises with the same slope. By maintaining these slopes (rate of change) in this manner, the voltage controlled resistor Rcv of the embodiments of the invention becomes a temperature dependent term with positive temperature dependence. This positive temperature dependence is controlled to cancel the negative temperature dependence of the mobility term, and thus the output current Iref can be maintained at a predetermined constant current over temperature.

Figures 9, 9A, 9B:
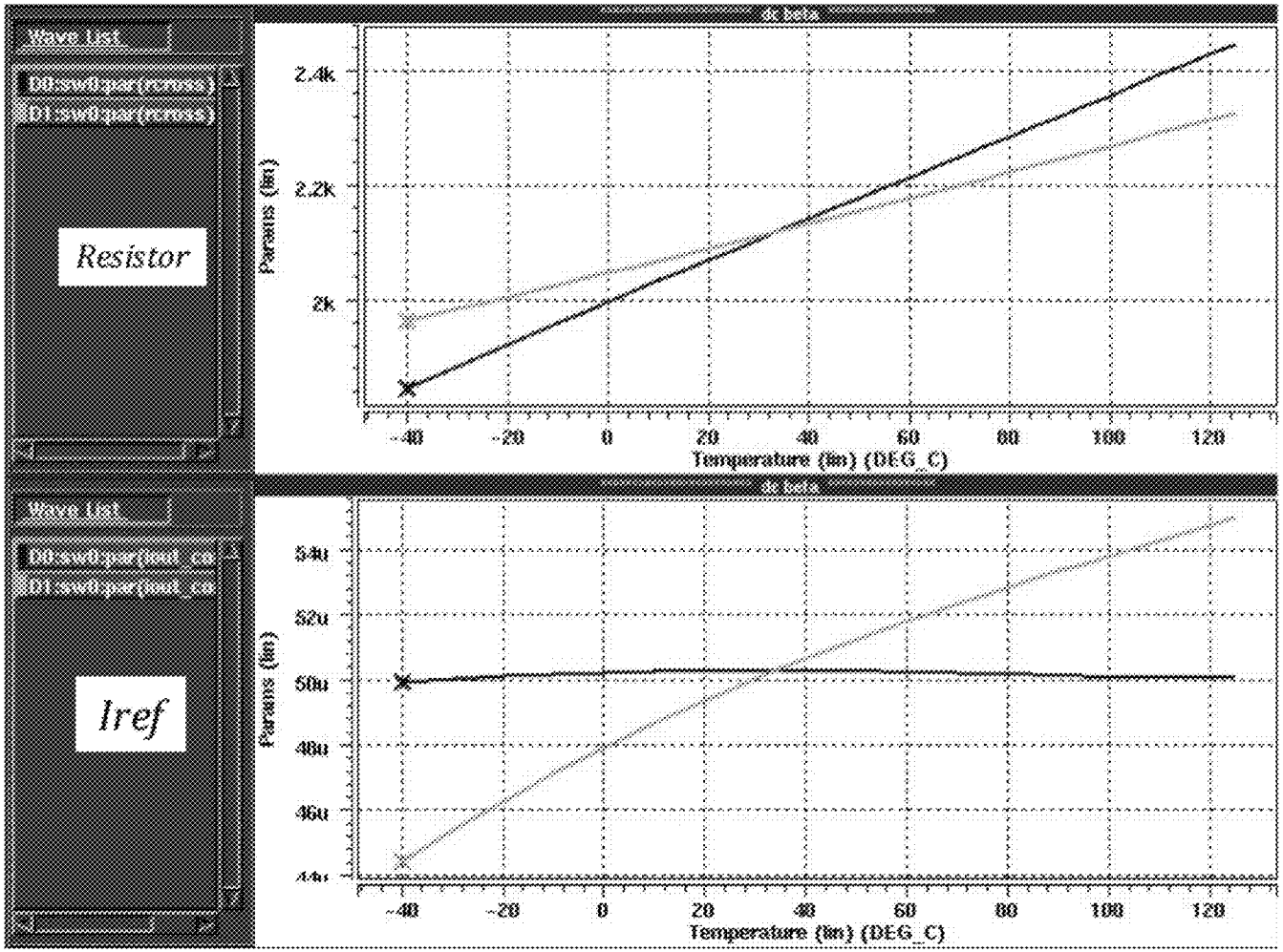
FIG. 9 illustrates in two graphical views, FIG. 9*a* and FIG. 9*b*, the current Iref obtained over temperature for the embodiments of the present invention, compared to the ideal circuit, Iref over temperature.

FIG. 9*a* depicts the prior art fixed resistor plotted over temperature, compared to the value of a voltage controlled resistor of the exemplary embodiments plotted over temperature. In FIG. 9*b*, the corresponding output currents Iref obtained from constant Gm circuits of the prior art and an exemplary embodiment constant Gm circuit of the present invention are depicted.

FIG. 9*a* depicts the performance of a prior art resistor over temperature. The fixed value resistor has the desired positive temperature coefficient, but the slope (the less steep line) is not of sufficient value to compensate for the negative temperature coefficient of the mobility term $\mu_p C_{ox}(W/L)_P$, as described above. In FIG. 9*a*, the steeper line plots the value of the voltage controlled resistor of exemplary embodiments of the present invention against temperature, and shows how it has stronger positive temperature dependence.

The corresponding constant current Iref for each case is plotted over temperature in FIG. 9*b*. The line that varies the most depicts the performance of the prior art approach with a fixed resistor; at −40 degrees C. the current was measured at 44 microamps. At the maximum plotted temperature of 125 degrees C., the light line indicates an Iref current of 55 microamps. This corresponds to a difference of 11 microamps, or a variance of 23.73%.

The more horizontal line in FIG. 9*b* depicts the performance of a constant Gm circuit embodiment incorporating the features of the present invention. The current Iref for this circuit begins at around 50 microamps at −40 degrees C. and its greatest value (around 20 degrees C. in the plot) is about 50.1 microamps. This represents a temperature dependent variance of only 0.72%.

Figure 10:
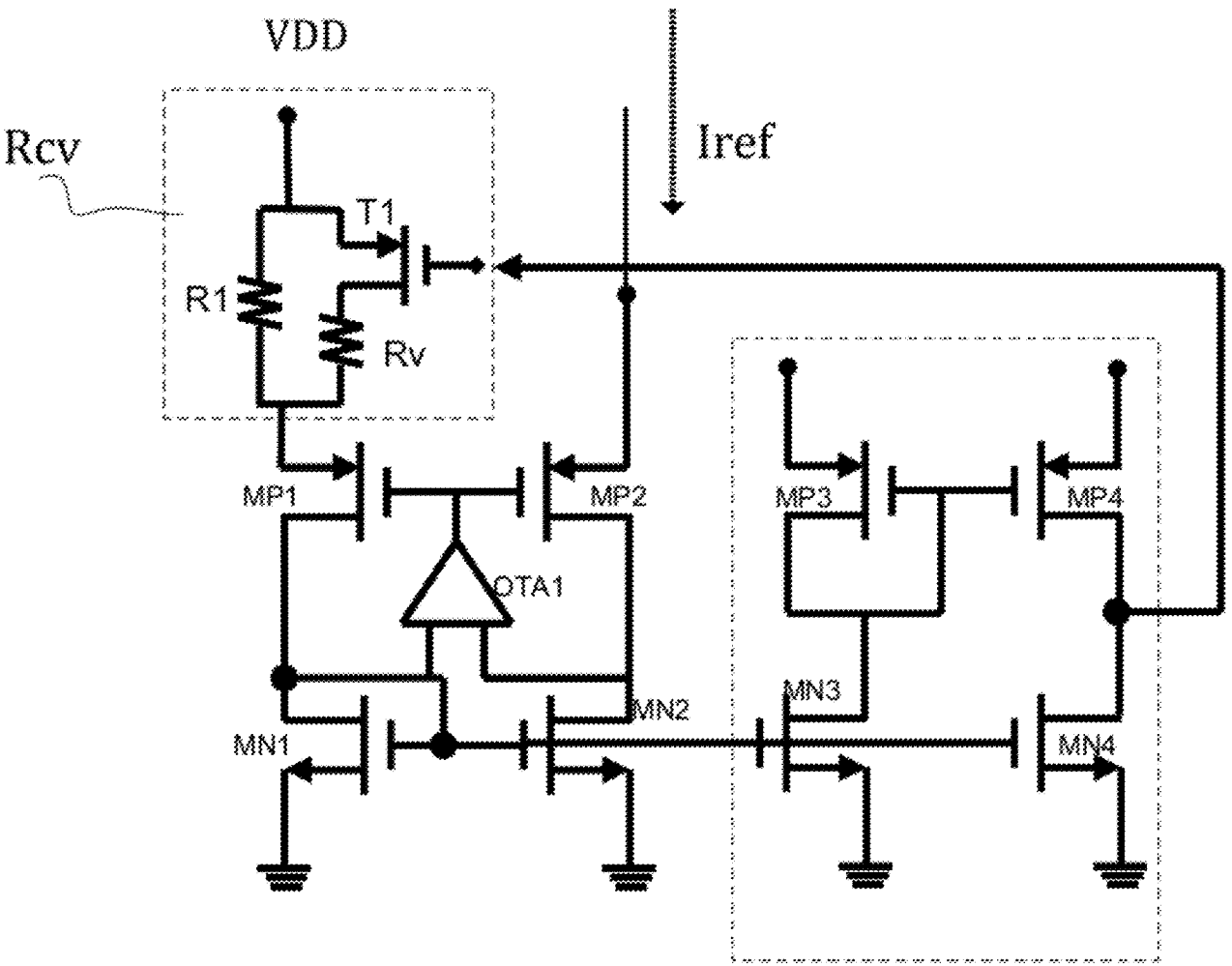
FIG. 10 depicts a schematic for an alternative embodiment of the invention using a transconductance amplifier.

FIG. 10 depicts an alternative embodiment of the constant Gm circuit of the invention. In FIG. 10, the input stage includes the voltage dependent resistor with feedback, and an operational transconductance amplifier OTA1. This element may improve the performance of the constant Gm circuit still further and is compatible with and additional advantages accrue when the embodiment of the constant Gm circuit using the OTA is combined with the voltage dependent resistor and feedback features of the present invention.

There are several advantages of the use of constant Gm circuit and method embodiments of the present invention. The constant current variation can be reduced to less than 1% over the specified temperature range vs. over 23% for the constant Gm circuit of the prior art. The improvements are achieved using only 9 transistors.

Further advantages are that even in the advanced semiconductor processes currently in development, embodiments of the invention will be compatible with these processes, as the OD resistor may be used. Further embodiments of the invention may be used in logic or mixed signal processes, as the circuitry is simple and compatible with any semiconductor process, whether optimized for analog circuits or for digital logic. Embodiments of the invention require small additional increases in circuit area.

Although exemplary embodiments of the present invention and its advantages have been described in detail, it should be understood that various changes, substitutions and alterations can be made herein without departing from the spirit and scope of the invention as defined by the appended claims. For example, it will be readily understood by those skilled in the art that the methods may be varied while remaining within the scope of the present invention.

Moreover, the scope of the present application is not intended to be limited to the particular embodiments of the methods and steps described in the specification. As one of ordinary skill in the art will readily appreciate from the disclosure of the present invention, processes or steps, presently existing or later to be developed, that perform substantially the same function or achieve substantially the same result as the corresponding embodiments described herein may be utilized according to the present invention. Accordingly, the appended claims are intended to include within their scope such processes or steps.

What is claimed is:

1. An apparatus, comprising:

a voltage controlled resistor coupled to a supply voltage and having an input for receiving a feedback voltage for varying a value of the voltage controlled resistor;

a constant Gm circuit coupled to the voltage controlled resistor and having an output that provides a constant current; and a feedback circuit coupled to a voltage node within the constant Gm circuit and providing the feedback voltage coupled to the input of the voltage controlled resistor to control the value of the voltage controlled resistor;

wherein the constant Gm circuit has a negative temperature dependency and the voltage controlled resistor has a positive temperature dependency.

2. The apparatus of claim 1, wherein the feedback circuit comprises an amplifier having a negative gain.

3. The apparatus of claim 1, wherein the constant Gm circuit further comprises:

a first P type MOS transistor having its current conduction path coupled between the voltage controlled resistor and a first node and having a gate;

a first N type MOS transistor being diode coupled between the first node and a ground reference, and having its gate coupled to the first node;

a second N type MOS transistor having its current conduction path coupled between a second node and the ground reference and having its gate coupled to the first node; and a second P type MOS transistor having its current conduction path coupled between the constant current output and the second node, and being diode coupled with its gate coupled to the gate of the first P type transistor;

wherein the constant current output is independent of the supply voltage.

4. The apparatus of claim 1, wherein the voltage controlled resistor further comprises:

a MOS transistor coupled between the supply voltage and a fixed resistor to provide current to the fixed resistor in response to the feedback voltage coupled to a gate terminal of the MOS transistor; and a second fixed resistor coupled in parallel to the series coupled MOS transistor and the fixed resistor.

5. The apparatus of claim 4, wherein the MOS transistor is a P type MOS transistor.

6. The apparatus of claim 5, wherein as the feedback voltage falls, the P type MOS transistor increases current to the fixed resistor, thus increasing the value of the voltage controlled resistor.

7. The apparatus of claim 6, wherein as the feedback voltage rises, the P type MOS transistor decreases current to the fixed resistor, thus decreasing the value of the voltage controlled resistor.

8. The apparatus of claim 1, wherein a slope of the temperature dependence of the mobility for the constant Gm circuit is approximately equal to and inverted from a slope of the temperature dependence of the voltage controlled resistor.

9. A semiconductor device, comprising:

a voltage controlled resistor formed over an active area of a semiconductor substrate and coupled between a voltage supply and a node and having a control input;

a first plurality of transistors formed in the semiconductor substrate, the transistors being of first and second conductivity types and coupled to form a constant Gm circuit, having the node as an input and having a constant current output; and a second plurality of transistors formed in the semiconductor substrate and coupled to form a negative gain feedback amplifier, coupled to a voltage node within the constant Gm circuit, and outputting an inverted feedback voltage;

wherein the inverted feedback voltage is coupled to the control input to control the voltage controlled resistor.

10. The semiconductor device of claim 9, wherein the first plurality of transistors further comprises:

a first P type MOS transistor having its current conduction path coupled between the node and the voltage node of the constant Gm circuit, and having a gate terminal;

a first N type MOS transistor diode coupled and having its current conduction path coupled between the voltage node of the constant Gm circuit and a ground voltage, and forming a voltage at its gate terminal which is further coupled to the voltage node of the constant Gm circuit;

a second N type MOS transistor having its gate terminal coupled to the voltage node and having its current conduction path coupled between the ground voltage and a third node; and a second P type transistor diode coupled between the third node and the constant current output having its gate terminal coupled to the gate terminal of the first P type transistor, and having its current conduction path coupled to sink the constant current output;

wherein the constant current output is maintained at a predetermined level independent of variations in the voltage supply.

11. The semiconductor device of claim 9, wherein the voltage controlled resistor further comprises:

a first fixed resistor coupled between the voltage supply and the node; and a second resistor element comprising a transistor having its current conduction path coupled between the voltage supply and the node, and forming a parallel current path to the first fixed resistor;

wherein the transistor further comprises a gate coupled to the control input for receiving the inverted feedback voltage, a resistance of the voltage controlled resistor varying with the inverted feedback voltage.

12. The semiconductor device of claim 11, wherein the second resistor element further comprises a second fixed resistor coupled in series with the transistor.

13. The semiconductor device of claim 12, wherein the fixed resistors comprise oxide diffusion resistors.

14. The semiconductor device of claim 12, wherein the fixed resistors comprise polysilicon resistors.

15. The semiconductor device of claim 12, wherein the fixed resistors comprise a combination of oxide diffusion and polysilicon resistors.

16. A method, comprising:

providing a resistance that is dependent on a control voltage input to provide a temperature dependent current from a positive power supply;

sinking a constant current into a current mirror, the constant current proportional to the temperature dependent current, the current minor gain being temperature dependent;

receiving a voltage at a voltage node in the current mirror that varies with variations in the temperature dependent current; and providing a negative feedback loop that is coupled to the voltage node and controls the resistance with a negative feedback voltage coupled to the control voltage input;

wherein the constant current is provided independent of variations in temperature.

17. The method of claim 16, wherein providing the resistance comprises:

providing a first fixed resistor coupled between the positive power supply and a node; and providing a voltage controlled resistor element in parallel to the first fixed resistor that has a current conduction path and that receives the control voltage input and that varies the resistance of the current conduction path in response to the negative feedback voltage.

18. The method of claim 17, wherein providing the voltage controlled resistor element further comprises:

providing a transistor having its current conduction path coupled between the positive power supply and a second fixed resistor and receiving the negative feedback voltage on its gate input.

19. The method of claim 16, wherein the resistance has a positive temperature dependence.

20. The method of claim 16, wherein the voltage at the voltage node has a negative temperature dependence.

* * * * *